US010631641B2

(12) United States Patent
Ni

(10) Patent No.: US 10,631,641 B2
(45) Date of Patent: Apr. 28, 2020

(54) SPIRAL ADJUSTING SWIVEL CHAIR TRAY FOR CHANGING ANGLE OF TORSION SPRING

(71) Applicant: Hangzhou Zhongtai Industrial Group Co., Ltd., Zhejiang (CN)

(72) Inventor: Yongxing Ni, Zhejiang (CN)

(73) Assignee: Hangzhou Zhongtai Industrial Group Co., Ltd., Zhejiang (CN)

( * ) Notice: Subject to any disclaimer, the term of this patent is extended or adjusted under 35 U.S.C. 154(b) by 44 days.

(21) Appl. No.: 16/039,287

(22) Filed: Jul. 18, 2018

(65) Prior Publication Data

US 2019/0343284 A1 Nov. 14, 2019

(30) Foreign Application Priority Data

May 11, 2018 (CN) ..... 2018 2 0705831 U

(51) Int. Cl.
*A47C 1/03* (2006.01)
*A47C 1/032* (2006.01)
*A47C 3/026* (2006.01)

(52) U.S. Cl.
CPC ..... *A47C 1/03274* (2018.08); *A47C 1/03255* (2013.01); *A47C 3/026* (2013.01)

(58) Field of Classification Search
CPC ..... A47C 1/03274; A47C 1/03279; A47C 1/03255; A47C 3/026
USPC ..... 297/303.3
See application file for complete search history.

(56) References Cited

U.S. PATENT DOCUMENTS 4,796,950 A * 1/1989 Mrotz, III ..... A47C 3/026 248/608
5,772,282 A * 6/1998 Stumpf ..... A47C 1/03 297/302.3
6,447,063 B1 * 9/2002 Beggs ..... A47C 1/03255 297/300.5
6,659,554 B2 * 12/2003 Su ..... A47C 1/0246 297/301.3
7,410,216 B2 * 8/2008 Rutnnan ..... A47C 1/03255 297/300.1
7,866,750 B2 * 1/2011 Bock ..... A47C 1/024 297/303.1
8,899,681 B2 * 12/2014 Ko ..... A47C 1/03261 297/302.3
10,130,184 B2 * 11/2018 Lin ..... A47C 1/03266
(Continued)

FOREIGN PATENT DOCUMENTS

CN 2587252 11/2003

*Primary Examiner* — Mark R Wendell
(74) *Attorney, Agent, or Firm* — JCIPRNET

(57) ABSTRACT

The present invention relates to a swivel chair tray, and more particularly relates to a spiral adjusting swivel chair tray for changing the angle of a torsion spring. The present invention mainly solves the technical problems existing in the prior art, for example, the swivel chair tray cannot adjust the angle of the torsion spring, so the adjustment degree of the seat cannot be changed and the operation is relatively inconvenient. The present invention includes a base plate, wherein the base plate is connected to a middle seat through a shaft. The middle seat is fixedly provided with a tapered tube through a tapered tube pad. A torsion spring is sleeved over the shaft, and the torsion spring is connected to an adjusting mechanism for adjusting the angle of the torsion spring through a torsion spring fixing block.

8 Claims, 5 Drawing Sheets

(56) References Cited

U.S. PATENT DOCUMENTS

| | | | | |
|---|---|---|---|---|
| 2003/0075961 | A1* | 4/2003 | Struppler | A47C 1/03255 297/300.5 |
| 2008/0252125 | A1* | 10/2008 | Bock | A47C 1/03255 297/313 |
| 2011/0181086 | A1* | 7/2011 | Pfeifer | A47C 1/03255 297/300.1 |
| 2012/0205952 | A1* | 8/2012 | Takeuchi | A47C 1/03 297/300.1 |
| 2014/0028068 | A1* | 1/2014 | Birkbeck | A47C 1/022 297/340 |
| 2016/0192782 | A1* | 7/2016 | He | A47C 1/03272 297/285 |
| 2018/0332967 | A1* | 11/2018 | Jin | A47C 1/03255 |

* cited by examiner

SPIRAL ADJUSTING SWIVEL CHAIR TRAY FOR CHANGING ANGLE OF TORSION SPRING

CROSS-REFERENCE TO RELATED APPLICATION

This application claims the priority benefit of China application serial no. 201820705831.2, filed on May 11, 2018. The entirety of the above-mentioned patent application is hereby incorporated by reference herein and made a part of this specification.

TECHNICAL FIELD

The present invention relates to a swivel chair tray, and more particularly relates to a spiral adjusting swivel chair tray for changing the angle of a torsion spring.

BACKGROUND ART

A currently known swivel chair tray consists of an upper tray, a lower support beam, a support shaft and spring device components, wherein the swivel chair can make proper pitching around the support shaft just after the upper tray and the back of a swivel chair seat are fixed, which can make a user feel comfortable. A Chinese patent (Publication Number of Grant: CN 2587252Y) discloses a tray, which mainly comprises a base plate, a movable seat, a tapered tube and an adjusting device, wherein the movable seat is fixedly connected to the base plate, a tapered tube fixing plate is provided on the other side of the movable seat, and the taper tube fixing plate, the movable seat and the tapered tube are fixedly connected; the adjusting device comprises an adjusting rod, an adjusting plate, a torsion spring, and a torsion spring fixing plate, wherein the adjusting rod is inserted in the movable seat, the adjusting plate is fixedly connected to the end of the adjusting rod that is inserted in the movable seat, one face of the adjusting plate is in contact with an air pressure rod, and the other face is connected to the torsion spring; the other face of the adjusting plate is provided with an adjusting plate rotation stopping pad; the movable seat is riveted to the base plate with a rivet, a tapered tube is welded in the central position of the movable seat, the torsion spring and the torsion spring fixing plate are both wound on the rivet, one end of the torsion spring is fixed on the torsion spring fixing plate, and an adjusting plate blister is provided on the adjusting plate; the tray is provided with a locking mechanism, and the locking mechanism mainly comprises a fixing block, a rivet, an adjusting rod, a roller seat, a roller, a roller pin, an adjusting sleeve, a rivet, an adjusting bolt, a compression spring, a fixing seat, a brake pad, a steel sleeve, and a locking nut; the fixing block, the end of which movably penetrates into the rivet, is fixedly connected to the movable seat; one end of the brake pad is movably fixed in the center of the rivet, and the other end of the brake pad is provided with a long kidney-shaped hole; the adjusting bolt penetrates into the hole, wherein one end of the adjusting bolt is screwed with a locking nut and sleeved with a steel sleeve, the outer surface of the steel sleeve movably matches one side of the fixing seat, the fixing seat is fixedly connected to the base plate, the other side of the fixing seat is fixedly connected to the adjusting sleeve, and the compression spring is in clearance fit with the inner side of the fixing seat; the compression spring is wound around the adjusting bolt, the end surface of the adjusting bolt is pressed against the roller, which is riveted on the roller seat with a roller pin, a rivet penetrates into the side face of the roller seat, and the side surface of the roller seat is in movable connection to the adjusting sleeve; the adjusting rod is welded at the inner side of the other end of the roller seat. However, such a swivel chair tray cannot adjust the angle of the torsion spring, so the adjustment degree of the seat cannot be changed and the operation is relatively inconvenient.

SUMMARY OF THE INVENTION

The present invention provides a spiral adjusting swivel chair tray for changing the angle of a torsion spring, which mainly solves the technical problems existing in the prior art, for example, the swivel chair tray cannot adjust the angle of the torsion spring, so the adjustment degree of the seat cannot be changed and the operation is relatively inconvenient.

The present invention mainly solves the above technical problems by the following technical solutions.

A spiral adjusting swivel chair tray for changing the angle of a torsion spring in the present invention comprises a base plate, wherein the base plate is connected to a middle seat through a shaft, the middle seat is fixedly provided with a tapered tube through a tapered tube pad, a torsion spring is sleeved over the shaft, and the torsion spring is connected to an adjusting mechanism for adjusting the angle of the torsion spring through a torsion spring fixing block. The present invention may bend a torsion spring by a certain angle by using an adjusting mechanism for adjusting the angle of the torsion spring, such that the torsion of the torsion spring can be changed, and the adjustment degree of the seat can be adjusted.

Preferably, the adjusting mechanism comprises an upper spiral adjusting block connected to the torsion spring fixing block, the lower portion of the upper spiral adjusting block is connected to a lower spiral adjusting block, the upper spiral adjusting block and the lower spiral adjusting block are connected by a spiral groove, the lower spiral adjusting block is connected to a torsion spring force adjusting handle, a large hole is formed in the top of a middle seat, and the torsion spring force adjusting handle is inserted into the large hole. After a relative movement between the upper spiral adjusting block and the lower spiral adjusting block, the total length of the upper spiral adjusting block and the lower spiral adjusting block may be changed by using the spiral groove, so the torsion spring fixing block can twist the torsion spring by a certain angle, thereby adjusting the torsion spring force.

Preferably, an adjusting block gear pad is provided between the lower spiral adjusting block and the middle seat. The mounting positions of the upper spiral adjusting block and the lower spiral adjusting block can be adjusted by the adjusting block gear pad.

Preferably, a limiting pin and an adjusting rod are also connected between the middle seat and the base plate. The function of the limiting pin is to control the movable range of the middle seat. The functions of the adjusting rod are locking and lifting, wherein the adjusting rod is pulled to complete the locking adjustment function, a retaining ring on the adjusting rod is inserted into the base plate side during locking, and the lifting adjustment function is completed when the adjusting rod is rotated.

Preferably, a retaining ring is sleeved over the adjusting rod on the outside of the base plate. The use of the retaining ring not only has a limiting function, but also prevents the adjusting rod from being damaged.

Preferably, a big muffler bushing is inserted between the torsion spring and the shaft. The use of the big muffler bushing can have the function of eliminating noise.

Therefore, the rotary chair tray of the present invention adjusts the angle of the torsion spring by rotating the torsion spring force adjusting handle, thereby realizing the rapid adjustment of the seat force. The adjustment through the handle is rapid, convenient and labor saving. The movable range of the middle seat is achieved by a positioning pin, and the angle can be changed according to needs, so the operation is relatively simple, and the structure is simple and reasonable.

Figure 1:
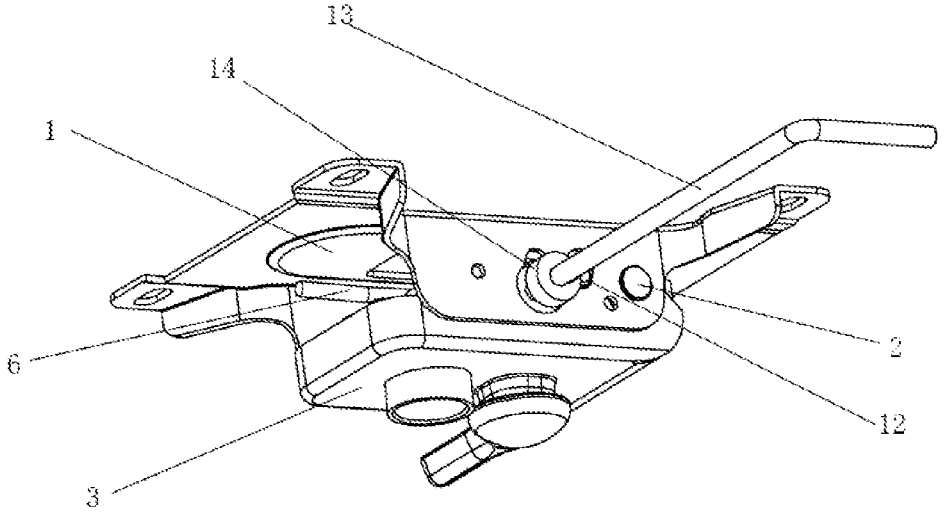
FIG. 1 is a structural schematic view of the present invention.

Components, parts and numbers in the drawings: base plate 1, shaft 2, middle seat 3, tapered tube pad 4, tapered tube 5, torsion spring 6, torsion spring fixing block 7, upper spiral adjusting block 8, lower spiral adjusting block 9, torsion spring force adjusting handle 10, adjusting block gear pad 11, limiting pin 12, adjusting rod 13, retaining ring 14, and big muffler bushing 15.

DETAILED DESCRIPTION OF THE INVENTION

The following further describes the technical solution of the present invention in detail by way of embodiments with reference to the accompanying drawings.

Figure 2:
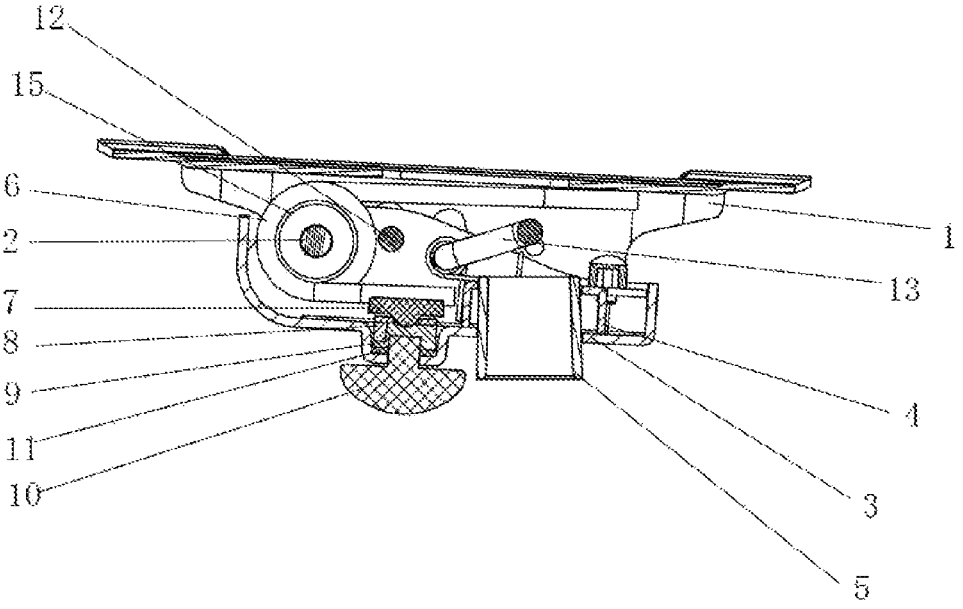
FIG. 2 is a sectional structural schematic view of the present invention.
Figure 3:
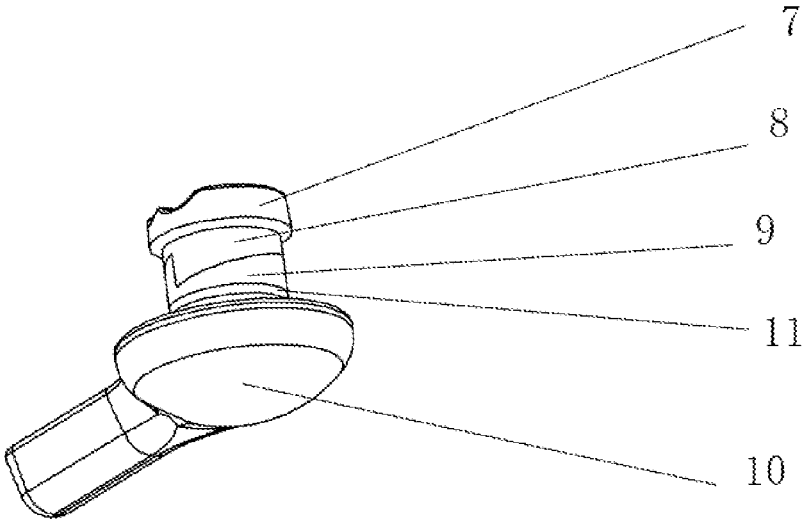
FIG. 3 is a structural schematic view of an adjusting mechanism of the present invention.

Embodiment: a spiral adjusting swivel chair tray for changing the angle of a torsion spring in this embodiment, as shown in FIGS. 1-3, comprises a base plate 1 that is connected to a middle seat 3 through a shaft 2, the middle seat is fixedly provided with a tapered tube 5 through a tapered tube pad 4, a torsion spring 6 is sleeved over the shaft, and the torsion spring is connected to an adjusting mechanism for adjusting the angle of the torsion spring through a torsion spring fixing block 7. As also shown in FIG. 3, the adjusting mechanism comprises an upper spiral adjusting block 8 connected to the torsion spring fixing block 7, the lower portion of the upper spiral adjusting block is connected to a lower spiral adjusting block 9, the upper spiral adjusting block and the lower spiral adjusting block are connected by a spiral groove, the lower spiral adjusting block is connected to a torsion spring force adjusting handle 10, a large hole is formed in the top of a middle seat, and the torsion spring force adjusting handle is inserted into the large hole. An adjusting block gear pad 11 is provided between the lower spiral adjusting block and the middle seat. A limiting pin 12 and an adjusting rod 13 are also connected between the middle seat and the base plate. A retaining ring 14 is sleeved over the adjusting rod 13 on the outside of the base plate. A big muffler bushing 15 is inserted between the torsion spring and the shaft.

Figure 4:
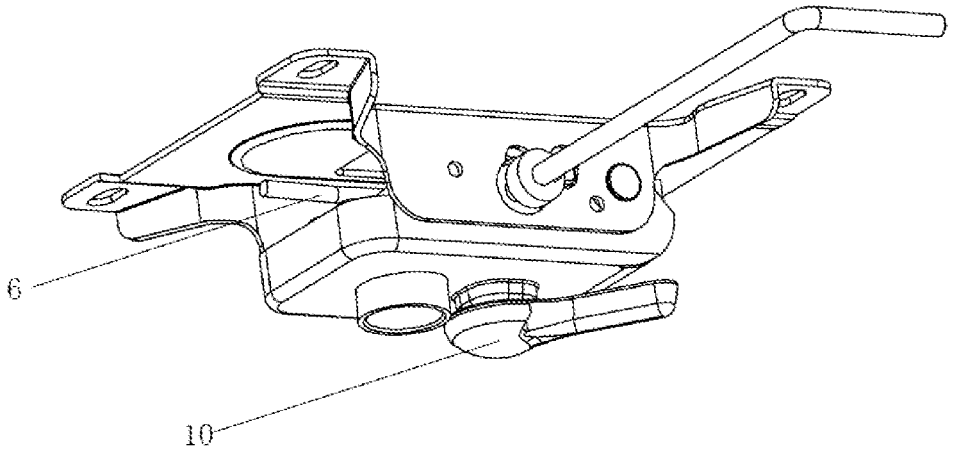
FIG. 4 is a structural schematic view of a torsion spring force adjusting handle after rotation in the present invention.
Figure 5:
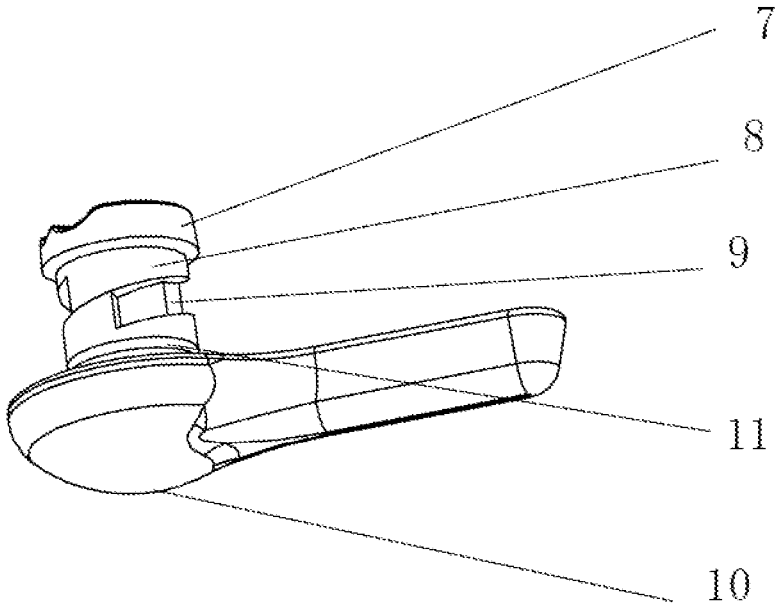
FIG. 5 is a structural schematic view of an adjusting mechanism after rotation of the torsion spring force adjusting handle in the present.

In use, as shown in FIG. 4 and FIG. 5, the torsion spring force adjusting handle 10 is rotated, and the upper spiral adjusting block 8 and the lower spiral adjusting block 9 are relatively moved through a spiral groove, thus adjusting the angle of the torsion spring 6.

The foregoing descriptions are merely specific embodiments of the present invention, but the structural features of the present invention are not limited thereto, and any changes or modifications made by any person skilled in the art of the present invention are covered within the scope of the patent of the present invention.

What is claimed is:

1. A spiral adjusting swivel chair tray for changing the angle of a torsion spring, comprising: a base plate, wherein the base plate is connected to a middle seat through a shaft, the middle seat is fixedly provided with a tapered tube through a tapered tube pad, a torsion spring is sleeved over the shaft, and the torsion spring is connected to an adjusting mechanism for adjusting the angle of the torsion spring through a torsion spring fixing block, wherein the adjusting mechanism comprises an upper spiral adjusting block connected to the torsion spring fixing block, the lower portion of the upper spiral adjusting block is connected to a lower spiral adjusting block, the upper spiral adjusting block and the lower spiral adjusting block are connected by a spiral groove, the lower spiral adjusting block is connected to a torsion spring force adjusting handle, a large hole is formed in the top of a middle seat, and the torsion spring force adjusting handle is inserted into the large hole.

2. The spiral adjusting swivel chair tray for changing the angle of a torsion spring according to claim 1, wherein an adjusting block gear pad is provided between the lower spiral adjusting block and the middle seat.

3. The spiral adjusting swivel chair tray for changing the angle of a torsion spring according to claim 2, wherein a limiting pin and an adjusting rod are also connected between the middle seat and the base plate.

4. The spiral adjusting swivel chair tray for changing the angle of a torsion spring according to claim 3, wherein a retaining ring is sleeved over the adjusting rod on the outside of the base plate.

5. The spiral adjusting swivel chair tray for changing the angle of a torsion spring according to claim 2, wherein a big muffler bushing is inserted between the torsion spring and the shaft.

6. The spiral adjusting swivel chair tray for changing the angle of a torsion spring according to claim 1, wherein a limiting pin and an adjusting rod are also connected between the middle seat and the base plate.

7. The spiral adjusting swivel chair tray for changing the angle of a torsion spring according to claim 6, wherein a retaining ring is sleeved over the adjusting rod on the outside of the base plate.

8. The spiral adjusting swivel chair tray for changing the angle of a torsion spring according to claim 1, wherein a big muffler bushing is inserted between the torsion spring and the shaft.

* * * * *